US010486425B2

(12) United States Patent
Tsubota

(10) Patent No.: US 10,486,425 B2
(45) Date of Patent: Nov. 26, 2019

(54) LIQUID EJECTING APPARATUS AND METHOD OF DRIVING THE SAME

(71) Applicant: SEIKO EPSON CORPORATION, Tokyo (JP)

(72) Inventor: Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/107,875

(22) Filed: Aug. 21, 2018

(65) Prior Publication Data

US 2019/0061354 A1 Feb. 28, 2019

(30) Foreign Application Priority Data

Aug. 22, 2017 (JP) ..... 2017-159784

(51) Int. Cl.
*B41J 2/165* (2006.01)

(52) U.S. Cl.
CPC ..... *B41J 2/16511* (2013.01); *B41J 2/165* (2013.01); *B41J 2/16508* (2013.01); *B41J 2/16523* (2013.01); *B41J 2/16526* (2013.01); *B41J 2/16552* (2013.01)

(58) Field of Classification Search
CPC .... B41J 2/16511; B41J 2/165; B41J 2/16508; B41J 2/16523; B41J 2/16526; B41J 2/16552; B41J 2/16505
See application file for complete search history.

(56) References Cited

U.S. PATENT DOCUMENTS

| | | | | |
|---|---|---|---|---|
| 2009/0109257 | A1 | 4/2009 | Shimazaki | |
| 2011/0242206 | A1 | 10/2011 | Komatsu et al. | |
| 2016/0003122 | A1* | 1/2016 | Kobayashi | B41J 2/16552 |
| 2018/0029368 | A1 | 2/2018 | Nakata et al. | |

FOREIGN PATENT DOCUMENTS

| | | | |
|---|---|---|---|
| JP | 2003-334961 | A | 11/2003 |
| JP | 2009-226719 | A | 10/2009 |
| JP | 5041106 | B | 7/2012 |
| JP | 5618054 | B | 9/2014 |
| JP | 2015-100924 | A | 6/2015 |
| JP | 2018-1663 | A | 1/2018 |
| JP | 2018-16035 | A | 2/2018 |

* cited by examiner

*Primary Examiner* — Juanita D Jackson
(74) *Attorney, Agent, or Firm* — Workman Nydegger

(57) ABSTRACT

A liquid ejecting apparatus includes a liquid ejecting head having an ejecting surface on which nozzles that eject a first liquid are formed, a cap having a recess configured to cover the nozzles when the ejecting surface is capped with the cap, a liquid storage section configured to store a second liquid to flow into the recess, a connection tube configured to interconnect the recess and the liquid storage section, and a pump configured to cause the second liquid to flow from the liquid storage section into the recess through the connection tube and to flow out of the recess and into the liquid storage section through the connection tube. The sectional area, parallel to the ejecting surface, of the recess is larger than the sectional area, parallel to the ejecting surface, of the connection tube.

8 Claims, 15 Drawing Sheets

LIQUID EJECTING APPARATUS AND METHOD OF DRIVING THE SAME

BACKGROUND

1. Technical Field

The present invention relates to a technique to eject a liquid such as an ink.

2. Related Art

A liquid ejecting apparatus has a liquid ejecting head that ejects a liquid such as an ink from nozzles. If such liquid ejecting apparatus is left standing while printing is not performed, the liquid in some nozzles may dry and the viscosity of the liquid may thereby increase. This may cause an ejecting failure. JP-A-2003-334961 discloses a structure in which a leaving cap used to seal the nozzles during non-printing is provided separately from a cap for cleaning the liquid ejecting head. Since the nozzles are sealed by the leaving cap during non-printing to suppress an increase in the viscosity of the liquid that would otherwise be caused when the liquid in some nozzles dries, it is possible to suppress an ejecting failure.

SUMMARY

When a leaving cap as described in JP-A-2003-334961 seals nozzles, liquid may drip from some nozzles into the cap. The liquid that has dripped into the cap is exposed to the ambient atmosphere until a next capping, and thus the ink is likely to dry. The next time the nozzles are capped, therefore, moisture in liquid in the nozzles is absorbed by the liquid dried in the cap. This facilitates an increase in the viscosity of the liquid in the nozzles. If an increase in the viscosity of the liquid in the nozzles is facilitated in this way, an ejecting failure (such as missing dots) may occur. An advantage of some aspects of the invention is to suppress an ejecting failure, which would otherwise be caused due to the evaporation of moisture in the nozzles while capping is in progress.

A liquid ejecting apparatus according to a first aspect of the invention includes a liquid ejecting head having an ejecting surface on which a nozzle that ejects a first liquid is formed, a cap having a recess that covers the nozzle when the ejecting surface is capped with the cap, a liquid storage section that stores a second liquid to flow into the recess, a connection tube that interconnects the recess and the liquid storage section, and a pump that causes the second liquid to flow from the liquid storage section into the recess through the connection tube or to flow out of the recess and into the liquid storage section through the connection tube. The sectional area, parallel to the ejecting surface, of the recess is larger than the sectional area, parallel to the ejecting surface, of the connection tube. According to the above aspect, when the ejecting surface is capped with the cap, moisture on the ejecting surface can be retained. When the liquid feeding pump causes the second liquid to flow from the liquid storage section into the recess through the connection tube or to flow out of the recess and into the liquid storage section through the connection tube, the recess in the cap can be cleaned. Even if ink drips into the recess in the cap, when the recess is cleaned, the ink in the recess can be removed. Therefore, it is possible to restrain moisture in the nozzle from being absorbed by the ink in the recess. After that, therefore, moisture can be adequately retained in the nozzle by the cap. In addition, the sectional area, parallel to the ejecting surface, of the recess is larger than the sectional area, parallel to the ejecting surface, of the connection tube.

When the ejecting surface is capped with the cap, therefore, the effect of retaining moisture, the effect being provided by the second liquid flowed out of the recess and into the liquid storage section, is appropriately exerted in a sealed space in the recess, which covers the nozzle, through the connection tube, without being excessive or insufficient. Therefore, it is possible to appropriately retain the moisture of the first liquid in the nozzle. Thus, in this aspect, it is possible to suppress an ejecting failure that would otherwise be caused due to the evaporation of moisture in the nozzle during capping.

It is preferable that an air layer that communicates with the recess through the connection tube be formed in the liquid storage section before the ejecting surface is capped. Therefore, since an air layer that communicates with the recess through the connection tube is formed in the liquid storage section before the ejecting surface is capped, the air layer in the liquid storage section functions as a bumper that absorbs the shock of air transmitted to the nozzle when the ejecting surface is capped with the cap. Accordingly, it is possible to restrain meniscuses in the nozzle from being destroyed by the shock.

It is preferable that the connection tube be equipped with a switching valve to switch between a state of the recess being opened to the ambient atmosphere and a state of the recess communicating with the liquid storage section. Therefore, when the recess communicates with the liquid storage section by the switching valve, it is possible for the second liquid to flow from the liquid storage section into the recess or to flow out of the recess and into the liquid storage section. When the recess is opened to the ambient atmosphere by the switching valve, it is possible to restrain meniscuses in the nozzle from being destroyed by the shock of air, the shock being generated in the recess when the ejecting surface is capped with the cap.

It is preferable that the cap be equipped with a discharge tube through which the first and second liquids in the recess are discharged. Therefore, the first and second liquids in the recess can be discharged through the discharge tube without the liquids being returned to the liquid storage section through the connection tube. Accordingly, if the second liquid in the recess is dirty with the first liquid, the first and second liquids can be discarded through the discharge tube.

A method according to a second aspect of the invention is a method of driving a liquid ejecting apparatus that includes a liquid ejecting head having an ejecting surface on which a nozzle that ejects a first liquid is formed, a cap having a recess that covers the nozzle when the ejecting surface is capped with the cap, a liquid storage section that stores a second liquid to flow into the recess, a connection tube that interconnects the recess and the liquid storage section, and a pump that causes the second liquid to flow from the liquid storage section into the recess through the connection tube or to flow out of the recess and into the liquid storage section through the connection tube. The method includes causing the second liquid to flow from the liquid storage section into the recess through the connection tube or to flow out of the recess and into the liquid storage section through the connection tube by using the pump while the ejecting surface is not capped, and capping the ejecting surface with the cap after the first and second liquids in the recess have flowed out. According to the above aspect, even if ink drips into the recess in the cap, the recess can be cleaned according to the causing the second liquid to flow, and therefore the ink in the recess can be removed. Since, according to the capping, the ejecting surface can be capped with the cap the recess of which has been cleaned, it is possible to restrain moisture in the nozzle from being absorbed by the ink in the recess. Therefore, according to the capping, moisture can be adequately retained in the nozzle by the cap. Thus, it is possible to suppress an ejecting failure that would otherwise be caused due to the evaporation of moisture in the nozzle during capping.

It is preferable that, in the capping, an air layer that communicates with the recess through the connection tube be formed in the liquid storage section before the ejecting surface is capped. Therefore, since an air layer that communicates with the recess through the connection tube is formed in the liquid storage section before the ejecting surface is capped, the air layer in the liquid storage section functions as a bumper that absorbs the shock of air, the shock being generated in the recess when the ejecting surface is capped with the cap. Accordingly, it is possible to restrain meniscuses in the nozzle from being destroyed by the shock.

It is preferable that the connection tube be equipped with a switching valve to switch between a state of the recess being opened to the ambient atmosphere and a state of the recess communicating with the liquid storage section. The causing the second liquid to flow is executed in the state of the recess communicating with the liquid storage section by the switching valve. In the capping, the recess is opened to the ambient atmosphere by the switching valve before capping. After capping, the recess communicates with the liquid storage section by the switching valve. Therefore, since the causing the second liquid to flow is executed in the state in which the recess communicates with the liquid storage section by the switching valve, the recess can be cleaned. In the capping, since the recess is opened to the ambient atmosphere by the switching valve before capping, it is possible to restrain meniscuses in the nozzle from being destroyed by the shock of air, the shock being generated in the recess when the ejecting surface is capped with the cap. Furthermore, in the capping, after capping, the recess communicates with the liquid storage section by the switching valve, and therefore the effect of retaining moisture, the effect being provided by the second liquid in the liquid storage section, is exerted in the recess, which seals the nozzle, through the connection tube. Therefore, it is possible to appropriately retain the moisture of the first liquid in the nozzle.

It is preferable that the cap be equipped with a discharge tube through which the first and second liquids in the recess are discharged. In the causing the second liquid to flow, after the second liquid has flowed into the recess, the first and second liquids are discharged from the recess through the discharge tube or flow out of the recess and into the liquid storage section through the connection tube. Accordingly, when the second liquid flows out of the recess and into the liquid storage section through the connection tube, the second liquid can be returned to the liquid storage section, enabling the second liquid to be used again to clean the recess. The first and second liquids can also be discharged from the recess through the discharge tube, without being returned to the liquid storage section through the connection tube. Accordingly, if the second liquid in the recess is dirty with the first liquid, the first and second liquids can be discarded through the discharge tube.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
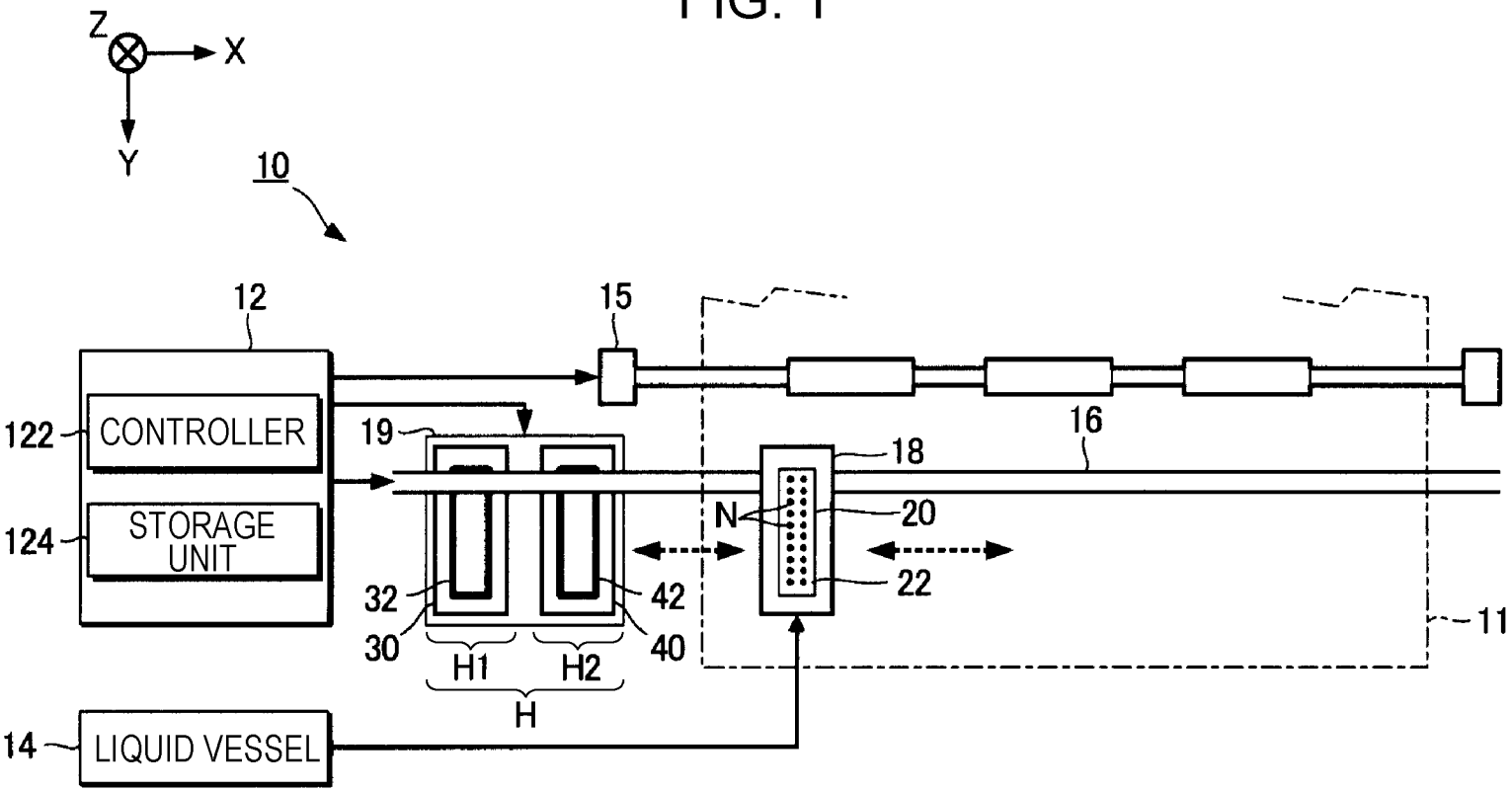
FIG. 1 illustrates the structure of a liquid ejecting apparatus according to a first embodiment.

FIG. 1 illustrates part of the structure of a liquid ejecting apparatus 10 according to a first embodiment of the invention. The liquid ejecting apparatus 10 in this embodiment is an ink jet printing apparatus that ejects an ink, which exemplifies a liquid, to a medium 11 such as a print sheet. The liquid ejecting apparatus 10 illustrated in FIG. 1 has a control unit 12, a transport mechanism 15, a moving mechanism 16, a carriage 18, a liquid ejecting head 20, and a maintenance unit 19. Although, in FIG. 1, a single liquid ejecting head 20 is mounted on the carriage 18 as an example, this is not a limitation; multiple liquid ejecting heads 20 may be mounted on the carriage 18. A liquid vessel 14 (cartridge), which stores an ink, is mounted in the liquid ejecting apparatus 10.

The liquid vessel 14 is an ink tank type of cartridge formed as a box-like vessel attachable to and detachable from the main body of the liquid ejecting apparatus 10. The liquid vessel 14 is not limited to a box-like vessel; the liquid vessel 14 may be an ink pack type of cartridge formed as a bag-like vessel. An ink is stored in the liquid vessel 14. The ink may be a black ink or a color ink. The ink stored in the liquid vessel 14 is supplied (pumped) to the liquid ejecting head 20 by a pump (not illustrated).

The control unit 12 includes a controller 122 such as, for example, a central processing unit (CPU) or a field programmable gate array (FPGA), and also includes a storage unit 124 such as, for example, a semiconductor memory. When the controller 122 executes a control program stored in the storage unit 124, elements in the liquid ejecting apparatus 10 are controlled in an overall manner. As illustrated in FIG. 1, print data representing an image to be formed on the medium 11 is supplied from an external apparatus (not illustrated) such as a host computer to the control unit 12. The control unit 12 controls elements in the liquid ejecting apparatus 10 so that the image specified by the print data is formed on the medium 11.

The transport mechanism 15 transports the medium 11 in the Y direction (sub-scanning direction) under control of the control unit 12. The moving mechanism 16 reciprocates the carriage 18 in the X direction (main scanning direction), which crosses the Y direction, under control of the control unit 12. However, the structures of the transport mechanism 15 and moving mechanism 16 are not limited to the above example. The liquid ejecting head 20, which is mounted on the carriage 18 shaped substantially like a box, ejects ink to the medium 11, the ink being supplied from the liquid vessel 14, under control of the control unit 12. The control unit 12 reciprocates the carriage 18 along the X direction. Since the liquid ejecting head 20 ejects ink to the medium 11 concurrently with the transport of the medium 11 by the transport mechanism 15 and the repeated reciprocation of the carriage 18, a desired image is formed on a surface of the medium 11. A direction perpendicular to an X-Y plane, which is parallel to a surface of the medium 11, will be referred to below as the Z direction.

Two nozzle rows are arranged on an ejecting surface (opposite to the medium 11) of the liquid ejecting head 20. Each nozzle row is a set of multiple nozzles N that are linearly disposed along the Y direction. Ink supplied from the liquid vessel 14 is ejected from each nozzle N. The number of nozzle rows and their arrangement are not limited to the above example; for example, a single nozzle row or three or more nozzle rows may be arranged on the ejecting surface 22 of the liquid ejecting head 20. It is also possible to arrange multiple nozzle rows in, for example, a staggered arrangement. The liquid ejecting head 20 includes multiple pairs of pressure chambers and piezoelectric elements (not illustrated), each pair corresponding to a different nozzle N. When a piezoelectric element is vibrated by a supplied driving signal and pressure in the corresponding pressure chamber is varied, ink in the pressure chamber is ejected from the corresponding nozzle N.

Figure 2:
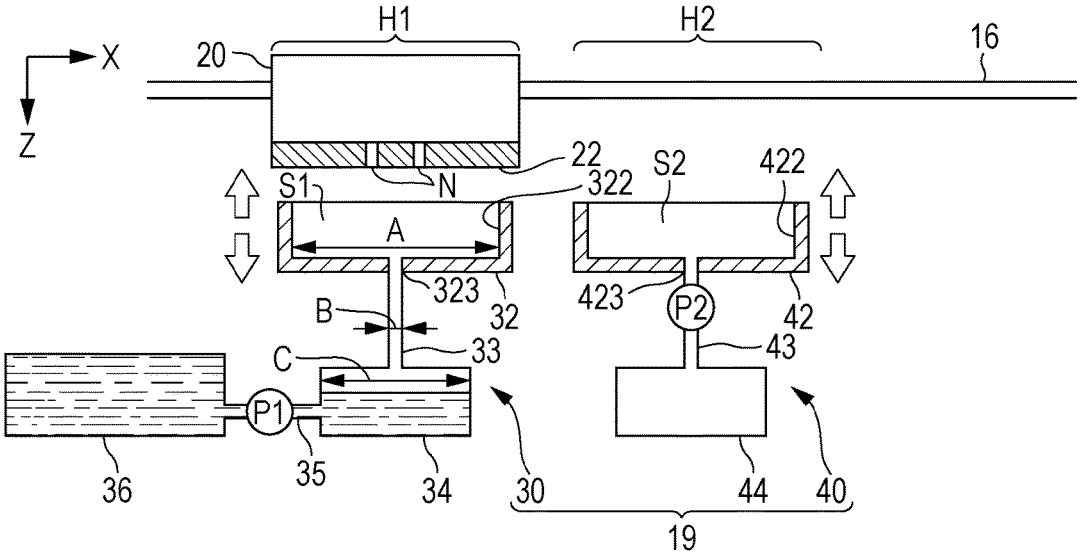
FIG. 2 is a sectional view illustrating the structure of a maintenance unit.

FIG. 2 is a sectional view that illustrates the structure of the maintenance unit 19 according to the first embodiment. As illustrated in FIGS. 1 and 2, the maintenance unit 19 has a moisture-retaining mechanism 30 (first maintenance mechanism) and a cleaning mechanism 40 (second maintenance mechanism). The maintenance unit 19 is disposed in, for example, a non-printing area H (area other than a print area to which the medium 11 is transported) on the liquid ejecting head 20 in the X direction. The non-printing area H in this embodiment includes a standby area H1 (first area), which is a home position, and a cleaning area H2 (second area). The moisture-retaining mechanism 30 is disposed in the standby area H1, and the cleaning mechanism 40 is disposed in the cleaning area H2.

The moisture-retaining mechanism 30 and cleaning mechanism 40 are arranged in a line in the X direction. In this embodiment, a case is exemplified in which, in the X direction, the cleaning mechanism 40 is closer to a printable area, to which the medium 11 is transported, than the moisture-retaining mechanism 30 is. However, the positional relationship between the moisture-retaining mechanism 30 and cleaning mechanism 40 is not limited to the example in this embodiment. Although, in this embodiment, a case is exemplified in which the moisture-retaining mechanism 30 and cleaning mechanism 40 are disposed in the maintenance unit 19, this is not a limitation; the moisture-retaining mechanism 30 may be disposed separately from the cleaning mechanism 40. If the moisture-retaining mechanism 30 is disposed separately from the cleaning mechanism 40, the moisture-retaining mechanism 30 may be disposed in the non-printing area H opposite to the cleaning mechanism 40 with the printable area interposed therebetween, the medium 11 being transported to the printable area.

The moisture-retaining mechanism 30 has a moisture-retaining cap 32 (first cap). The moisture-retaining cap 32, which is shaped substantially like a box, has a recess 322 that has an opening on the negative side in the Z direction. When the edge of the opening comes into contact with the ejecting surface 22 of the liquid ejecting head 20, the ejecting surface 22 is capped (sealed), forming a sealed space S1, which is enclosed by the recess 322 and ejecting surface 22, in the recess 322 in the moisture-retaining cap 32. By using a motor (not illustrated) under control of the control unit 12, the moisture-retaining cap 32 can be raised toward the negative side in the Z direction, in which the moisture-retaining cap 32 comes into contact with the ejecting surface 22, (moved upward), or can be lowered toward the positive side in the Z direction, in which the moisture-retaining cap 32 moves away from the ejecting surface 22, (moved downward).

While the liquid ejecting head 20 is in the standby area H1 during non-printing, the moisture-retaining mechanism 30 caps the ejecting surface 22 with the moisture-retaining cap 32, retaining moisture on the liquid ejecting head 20. If, for example, printing is not performed for a long time, when moisture on the ejecting surface 22 of the liquid ejecting head 20 is retained, it is possible to suppress evaporation of moisture from the interior of the nozzle N and thereby suppress an increase in the viscosity of ink. The structure of the moisture-retaining mechanism 30 will be concretely described below.

The cleaning mechanism 40 has a cleaning cap 42 (second cap). The cleaning cap 42, which is shaped substantially like a box, has a recess 422 that has an opening on the negative side in the Z direction. When the edge of the opening comes into contact with the ejecting surface 22 of the liquid ejecting head 20, the ejecting surface 22 is capped (sealed), forming a sealed space S2, which is enclosed by the recess 422 and ejecting surface 22, in the recess 422 of the cleaning cap 42. By using a motor (not illustrated) under control of the control unit 12, the cleaning cap 42 can be raised toward the negative side in the Z direction, in which the cleaning cap 42 comes into contact with the ejecting surface 22 (moved upward), or can be lowered toward the positive side in the Z direction, in which the cleaning cap 42 moves away from the ejecting surface 22 (moved downward).

As illustrated in FIG. 2, the cleaning mechanism 40 in this embodiment has the cleaning cap 42, a waste liquid section 44 (waste liquid tank), and a suction pump P2. The cleaning cap 42 has a through-hole 423 that passes through the bottom wall of the recess 422. A discharge tube 43 is connected to the through-hole 423. The recess 422 and waste liquid section 44 mutually communicate through the discharge tube 43. The suction pump P2 is disposed on the discharge tube 43. The waste liquid section 44 stores an ink to be discharged into the recess 422 of the cleaning cap 42. The ink discharged into the recess 422 of the cleaning cap 42 is discharged into the waste liquid section 44 through the discharge tube 43. An adsorption sheet that adsorbs ink may be provided in the recess 422 of the cleaning cap 42.

While the liquid ejecting head 20 is in the cleaning area H2 during cleaning, the cleaning mechanism 40 caps the ejecting surface 22 with the cleaning cap 42 and cleans the liquid ejecting head 20. Examples of cleaning of the liquid ejecting head 20 include suction cleaning by which ink is sucked from the nozzles N and flushing by which ink is ejected from the nozzles N toward the cleaning cap 42. Highly viscous ink and affixes in the nozzles N can be removed by suction cleaning or flushing. The maintenance unit 19 may have a wiper that wipes the ejecting surface 22. After the liquid ejecting head 20 has been cleaned, when the ejecting surface 22 is wiped with the wiper, ink and other smears adhering to the ejecting surface 22 can be removed.

In the maintenance unit 19 structured as described above in the cleaning of the liquid ejecting head 20, the liquid ejecting head 20 is moved to the cleaning area H2 with the carriage 18, after which the ejecting surface 22 is capped with the cleaning cap 42 and is cleaned. During non-printing, the liquid ejecting head 20 is moved to the standby area H1 with the carriage 18, after which the ejecting surface 22 is capped with the moisture-retaining cap 32 to retain moisture in the nozzles N.

When the ejecting surface 22 of the liquid ejecting head 20 is capped with the moisture-retaining cap 32, ink may drip from the nozzle N into the recess 322 in the moisture-retaining cap 32. If the ink that has dripped into the recess 322 in the moisture-retaining cap 32 is left standing, the ink is exposed to the ambient atmosphere until a next capping, and therefore the ink is likely to dry. When this happens, the next time the ejecting surface 22 is capped with the moisture-retaining cap 32, moisture in ink in the nozzle N is absorbed by the ink dried in the moisture-retaining cap 32. This facilitates an increase in the viscosity of the ink in the nozzle N. If an increase in the viscosity of ink in the nozzle N is facilitated in this way, an ejecting failure (such as landing of ink at an incorrect position on the medium 11 or missing dots) may occur. Particularly, if an ink, such as a sublimation transfer ink, that has a high ratio of an organic solvent and thereby easily dries is used, moisture in the nozzle N is absorbed by the ink dried in the moisture-retaining cap 32 and the viscosity of ink in the nozzles N is likely to be increased.

In the moisture-retaining mechanism 30, therefore, a liquid storage section 34 that supplies a liquid (such as water or a cleaning liquid) to the recess 322 in the moisture-retaining cap 32 is provided to communicate with the recess 322 through a connection tube 33. When liquid in the liquid storage section 34 flows into the recess 322 through the connection tube 33, the recess 322 can be cleaned. In this structure, even if ink drips into the recess 322 in the moisture-retaining cap 32, the ink in the recess 322 is removed by cleaning the recess 322. After that, therefore, moisture can be adequately retained in the nozzle N by the moisture-retaining cap 32.

A specific example of the structure of the moisture-retaining mechanism 30 in this embodiment will be described below. As illustrated in FIG. 2, the moisture-retaining mechanism 30 has the moisture-retaining cap 32, the liquid storage section 34 (sub-tank), a liquid supply source 36 (main tank), and a liquid-feeding pump P1. The liquid storage section 34 stores a liquid to flow into the recess 322 in the moisture-retaining cap 32. The liquid to be stored in the liquid storage section 34 is supplied from the liquid supply source 36. The liquid supplied to the recess 322 is water, a cleaning liquid, or the like.

A through-hole 323 passing through the bottom wall of the recess 322 is formed in the moisture-retaining cap 32. The connection tube 33 is connected to the through-hole 323. The connection tube 33 communicates between the recess 322 and the liquid storage section 34. The liquid storage section 34 is connected to the liquid supply source 36 through a liquid-feeding tube 35. The liquid-feeding pump P1 is provided on the liquid-feeding tube 35. The liquid-feeding pump P1 has a function to supply a liquid to the liquid storage section 34 and cause the liquid in the liquid storage section 34 to flow into the recess 322 through the connection tube 33, and also has a function to cause the liquid in the recess 322 to flow out into the liquid storage section 34 through the connection tube 33 and then return the liquid to the liquid supply source 36.

With this structure of the moisture-retaining mechanism 30, when the ejecting surface 22 is capped with the moisture-retaining cap 32, moisture on the ejecting surface 22 can be retained. When the liquid-feeding pump P1 causes the liquid to flow from the liquid storage section 34 into the recess 322 through the connection tube 33 or to flow out of the recess 322 and into the liquid storage section 34 through the connection tube 33, the recess 322 in the moisture-retaining cap 32 can be cleaned. Even if ink drips into the recess 322 in the moisture-retaining cap 32, therefore, the ink in the recess 322 can be removed by cleaning the recess 322. Therefore, it is possible to restrain moisture in the nozzle N from being absorbed by the ink in the recess 322. After that, therefore, moisture can be adequately retained in the nozzle N by the moisture-retaining cap 32. Thus, in this embodiment, it is possible to suppress an ejecting failure, which would otherwise be caused due to the evaporation of moisture in the nozzles N while the ejecting surface 22 is capped with the moisture-retaining cap 32.

The sectional area A, parallel to the ejecting surface 22, of the recess 322 in the moisture-retaining cap 32 (sectional area, parallel to the ejecting surface 22, of the sealed space S1) is larger than the sectional area B, parallel to the ejecting surface 22, of the connection tube 33 (sectional area, parallel to the ejecting surface 22, of the internal space in the connection tube 33). In this structure, while the ejecting surface 22 is capped with the moisture-retaining cap 32, the effect of retaining moisture, the effect being provided by the liquid flowed out of the recess 322 and into the liquid storage section 34, is appropriately exerted in the sealed space S1 through the connection tube 33, without being excessive or insufficient. Therefore, it is possible to appropriately retain the moisture of ink in the nozzle N.

As the sectional area B of the connection tube 33 becomes larger with respect to the sectional area A of the recess 322, the effect of retaining moisture in the recess 322 by the liquid in the liquid storage section 34 is more excessively exerted. This may lead to the risk that ink in the nozzle N excessively absorbs moisture and the ink is thinned. Conversely, if the sectional area B of the connection tube 33 is excessively small with respect to the sectional area A of the recess 322, the effect of retaining moisture in the recess 322 by the liquid in the liquid storage section 34 is not easily exerted. Therefore, the size of the sectional area A of the recess 322 in the moisture-retaining cap 32 and the size of the sectional area B of the connection tube 33 are preferably set to optimum values according to the effect of retaining moisture in the recess 322 by the liquid in the liquid storage section 34. Now, the sectional area, parallel to the ejecting surface 22, of the liquid storage section 34 (sectional area, parallel to the ejecting surface 22, of the internal space of the liquid storage section 34) will be denoted C. Then, the sectional area B of the connection tube 33 is smaller than the sectional area C of the liquid storage section 34. In this structure as well, the effect of retaining moisture in the nozzles N by liquid in the liquid storage section 34 can be appropriately maintained while the ejecting surface 22 is capped with the moisture-retaining cap 32.

Figure 3:
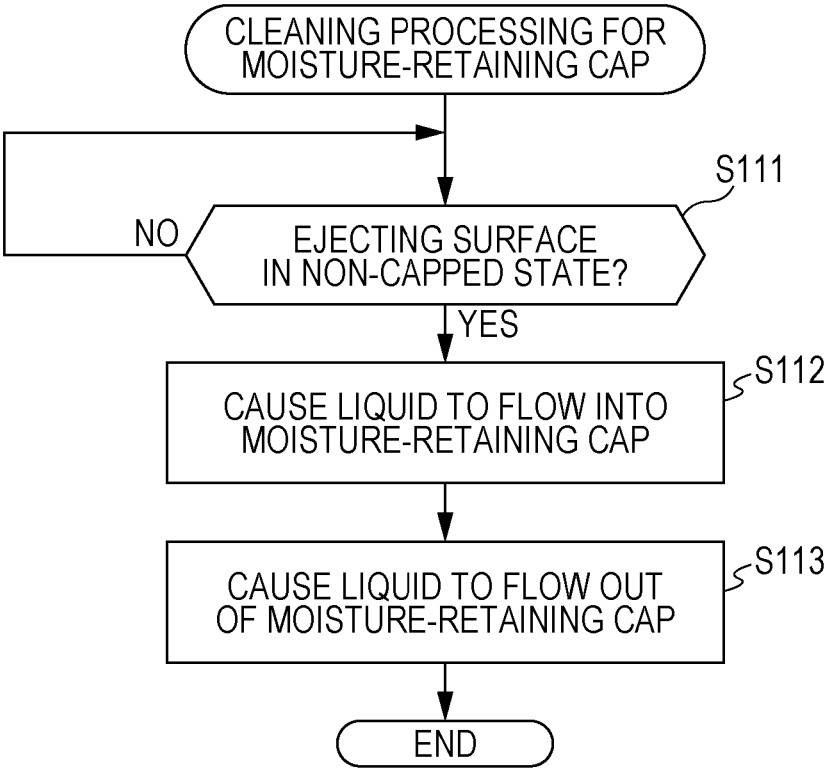
FIG. 3 is a flowchart illustrating cleaning processing for a moisture-retaining cap.
Figure 4:
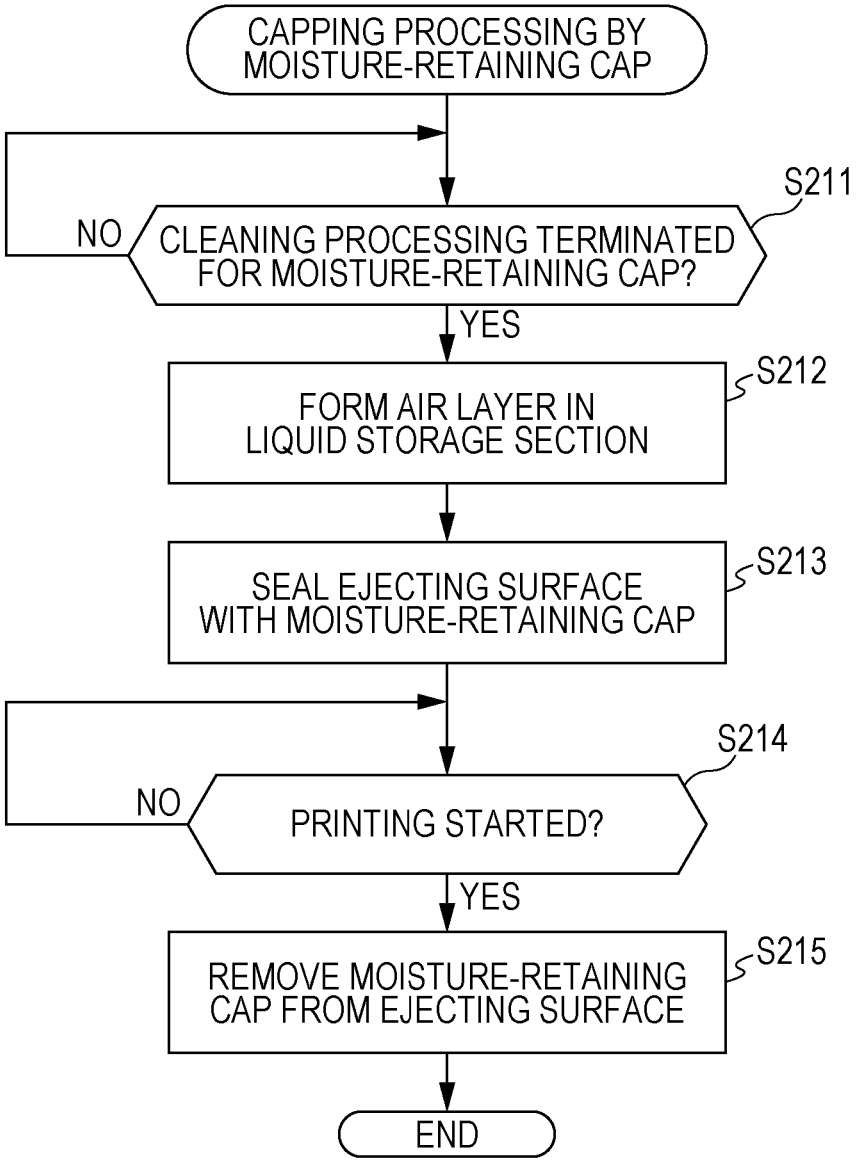
FIG. 4 is a flowchart illustrating capping processing performed for an ejecting surface by the moisture-retaining cap.
Figure 5A:
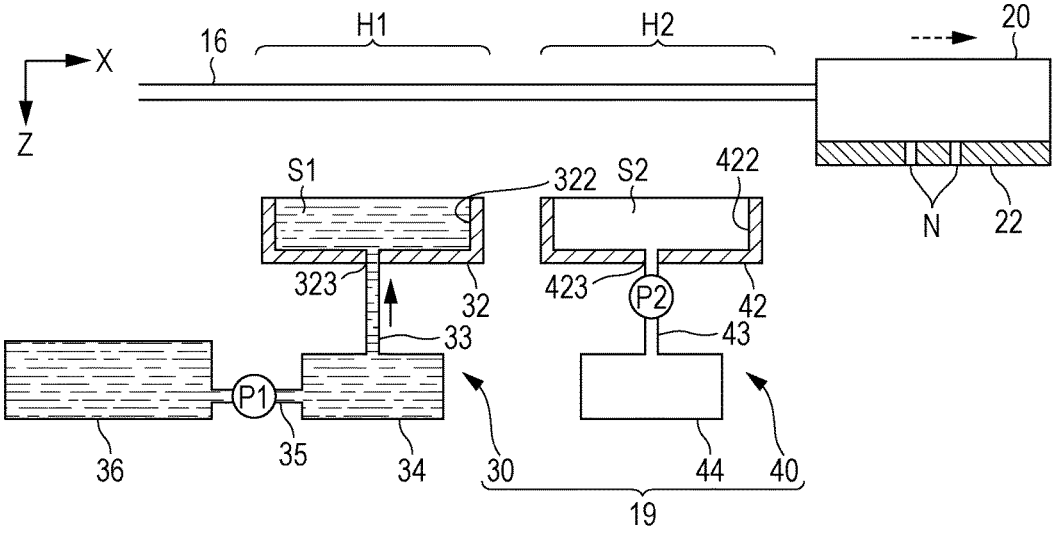
FIG. 5A is a sectional view illustrating a state in which liquid flows into the moisture-retaining cap in cleaning processing.
Figure 5B:
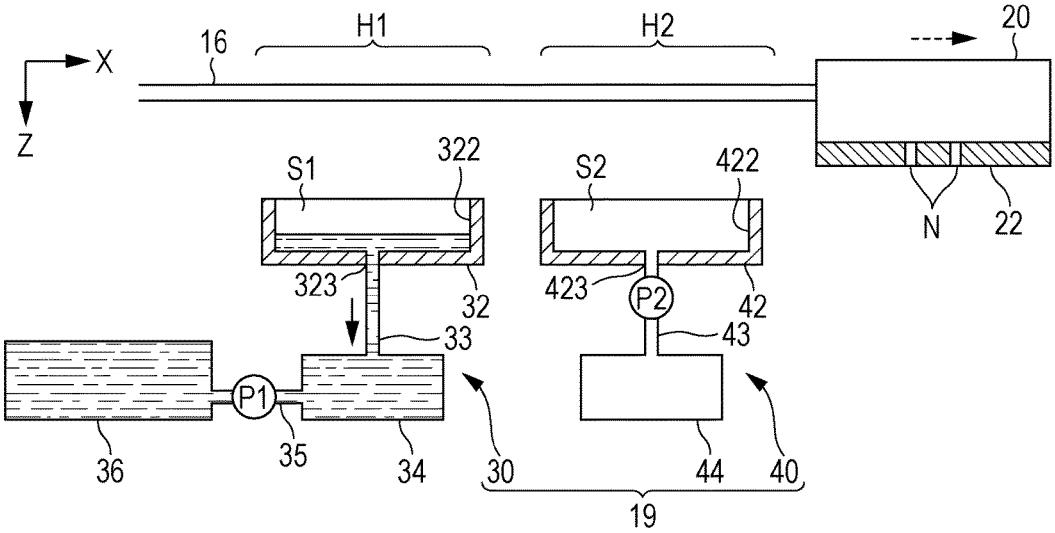
FIG. 5B is a sectional view illustrating a state in which liquid flows out of the moisture-retaining cap in cleaning processing.
Figure 6A:
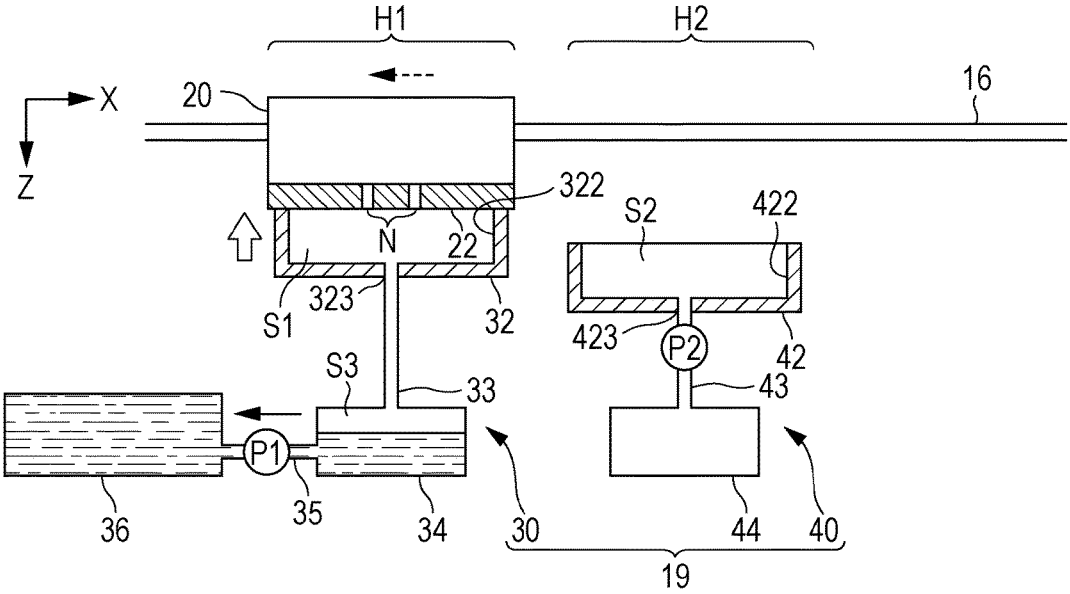
FIG. 6A is a sectional view illustrating a state in which the moisture-retaining cap is in contact in capping processing.
Figure 6B:
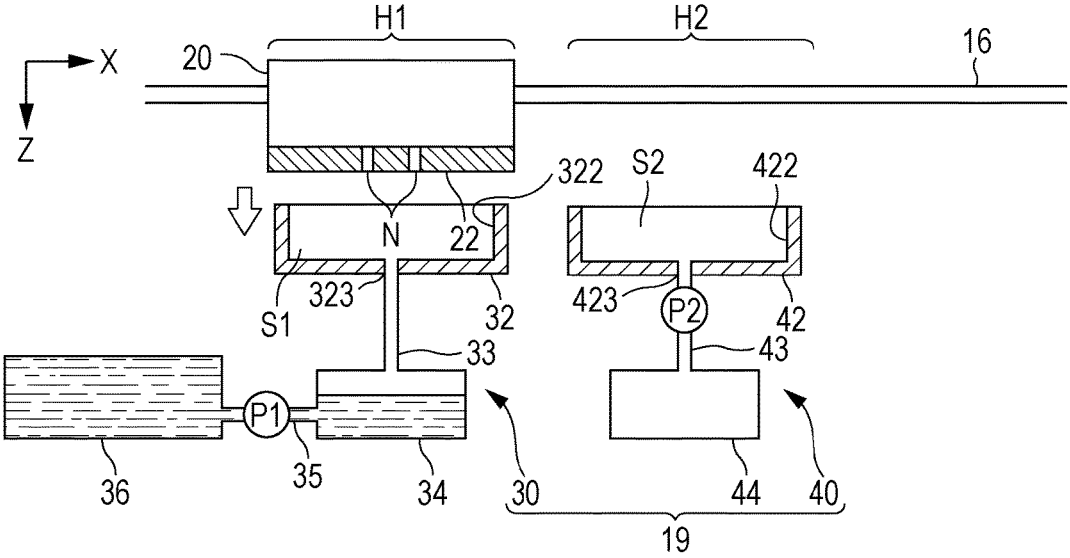
FIG. 6B is a sectional view illustrating a state in which the moisture-retaining cap is removed in capping processing.

The method of driving the liquid ejecting apparatus 10 described above, which uses the moisture-retaining mechanism 30, in the first embodiment will be described below. FIG. 3 is a flowchart in cleaning processing (first step) for the moisture-retaining cap 32 in the first embodiment. FIG. 4 is a flowchart in capping processing (second step) performed for the ejecting surface 22 by the moisture-retaining cap 32 in the first embodiment. FIGS. 5A and 5B are each a sectional view illustrating the state of the moisture-retaining cap 32 in cleaning processing in FIG. 3: FIG. 5A illustrates a state in which liquid flows into the moisture-retaining cap 32, and FIG. 5B illustrates a state in which liquid flows out of the moisture-retaining cap 32. FIGS. 6A and 6B are each a sectional view illustrating the state of the moisture-retaining cap 32 in capping processing in FIG. 4: FIG. 6A illustrates a state in which the moisture-retaining cap 32 is in contact with the ejecting surface 22, and FIG. 6B illustrates a state in which the moisture-retaining cap 32 is removed from the ejecting surface 22.

Cleaning processing (first step) in FIG. 3 is executed by the controller 122 during non-capping in which the ejecting surface 22 is not capped by the moisture-retaining cap 32. Capping processing in FIG. 4 is executed during non-printing after the cleaning of the moisture-retaining cap 32. However, capping processing does not necessarily need to be executed after the cleaning of the moisture-retaining cap 32. If, for example, the moisture-retaining cap 32 is used for the first time, it is not yet dirtied even before being cleaned. In this case, capping processing may be executed before the moisture-retaining cap 32 is cleaned. Cleaning processing in FIG. 3 and capping processing in FIG. 4 may be executed at timings prestored in the storage unit 124.

In cleaning processing in FIG. 3, the controller 122 first decides in step S111 whether the ejecting surface 22 of the liquid ejecting head 20 is not capped, that is, the ejecting surface 22 is in a non-capped state. If the controller 122 decides in step S111 that the ejecting surface 22 of the liquid ejecting head 20 is not in the non-capped state (the result is No), the controller 122 waits in step S111 until the ejecting surface 22 of the liquid ejecting head 20 enters the non-capped state.

If the controller 122 decides in step S111 that the ejecting surface 22 of the liquid ejecting head 20 is in the non-capped state (the result is Yes), the controller 122 causes the liquid to flow into the moisture-retaining cap 32 in step S112. Specifically, as illustrated in FIG. 5A, the controller 122 drives the liquid-feeding pump P1 to cause liquid to flow from the liquid storage section 34 into the recess 322 in the moisture-retaining cap 32 through the connection tube 33. In this case, the controller 122 supplies the liquid to an extent that the liquid does not spill from the recess 322.

Next, in step S113, the controller 122 causes the liquid to flow out of the moisture-retaining cap 32. Specifically, as illustrated in FIG. 5B, the controller 122 drives the liquid-feeding pump P1 to cause the liquid to flow out of the recess 322 in the moisture-retaining cap 32 and into the liquid storage section 34 through the connection tube 33. In this case, if there is no more liquid in the recess 322, the controller 122 terminates cleaning processing for the moisture-retaining cap 32.

Operations in steps S112 and S113 can be repeated multiple times. It is also possible to decide before step S112 whether printing has been terminated (whether capping is needed). If it is decided that printing has not been terminated, the controller 122 can wait without performing any operation until printing is terminated. If it is decided that printing has been terminated, the controller 122 can perform operations in steps S112 and S113. It is also possible to decide before step S113 whether printing has been terminated (whether capping is needed). If it is decided that printing has not been terminated, the controller 122 can wait without performing any operation until printing is terminated. If it is decided that printing has been terminated, the controller 122 can perform operation in steps S113. In this case, since liquid has been present in the recess 322 in the moisture-retaining cap 32 immediately before the ejecting surface 22 is capped with the moisture-retaining cap 32, capping can be performed in a state in which humidity in the recess 322 is high.

In capping processing (second step) in FIG. 4, the controller 122 first decides in step S211 whether cleaning processing has been terminated for the moisture-retaining cap 32. If the controller 122 decides that cleaning processing has not been terminated for the moisture-retaining cap 32 in step S211 (the result is No), the controller 122 waits in S211 until cleaning processing is terminated for the moisture-retaining cap 32.

If the controller 122 decides in step S211 that cleaning processing has been terminated for the moisture-retaining cap 32 (the result is Yes), the controller 122 forms, in the liquid storage section 34, an air layer S3 that communicates with the recess 322 through the connection tube 33 in step S212 before capping the ejecting surface 22 with the moisture-retaining cap 32. Specifically, as illustrated in FIG. 6A, the controller 122 drives the liquid-feeding pump P1 to lower the liquid surface of the liquid in the liquid storage section 34 until the air layer S3 is formed in the liquid storage section 34.

Next, the controller 122 seals the ejecting surface 22 with the moisture-retaining cap 32 in step S213. Specifically, as illustrated in FIG. 6A, the controller 122 moves the liquid ejecting head 20 to the standby area H1 and moves the moisture-retaining cap 32 toward the negative side in the Z direction so that the moisture-retaining cap 32 abuts the ejecting surface 22. At that time, the air layer S3 communicating with the recess 322 through the connection tube 33 is formed in the liquid storage section 34. Therefore, the air layer S3 in the liquid storage section 34 functions as a bumper that absorbs the shock of air transmitted to the nozzles N when the moisture-retaining cap 32 abuts the ejecting surface 22. Therefore, it is possible to restrain meniscuses in the nozzles N from being destroyed by the shock generated when the moisture-retaining cap 32 abuts the ejecting surface 22.

Since the air layer S3 in the liquid storage section 34 communicates with the sealed space S1 through the connection tube 33, moisture can be easily retained in the nozzles N by the liquid in the liquid storage section 34. In addition, since the recess 322 in the moisture-retaining cap 32 has been cleaned, ink that has dripped into the recess 322 can also be removed. Therefore, it is possible to restrain moisture in the nozzles N from being absorbed by the ink in the recess 322.

Next, the controller 122 decides in step S214 whether printing has been started. If the controller 122 decides in step S214 that printing has not been started (the result is No), the controller 122 waits with the ejecting surface 22 covered with the moisture-retaining cap 32 in step S214 until printing is started.

If the controller 122 decides in step S214 that printing has been started (the result is Yes), the controller 122 removes the moisture-retaining cap 32 from the ejecting surface 22 in step S215. Specifically, as illustrated in FIG. 6B, the controller 122 moves the moisture-retaining cap 32 toward the positive side in the Z direction to remove the moisture-retaining cap 32 from the ejecting surface 22 and terminates capping processing. At that time, the air layer S3 in the liquid storage section 34 functions as a bumper that absorbs the shock of air transmitted to the nozzles N when the moisture-retaining cap 32 is removed from the ejecting surface 22. Therefore, it is possible to restrain meniscuses in the nozzles N from being destroyed by the shock generated when the moisture-retaining cap 32 is removed from the ejecting surface 22.

After capping processing has been terminated, the controller 122 moves the liquid ejecting head 20 to the printing area and performs printing on the medium 11. Since, in this embodiment, moisture is retained in the nozzles N by the moisture-retaining cap 32 before printing is started, moisture in the nozzles N is not easily evaporated, suppressing an increase in the viscosity of ink. Therefore, when printing is performed on the medium 11, an ejecting failure can be suppressed. As described above, in this embodiment, it is possible to suppress an ejecting failure that would otherwise be caused due to the evaporation of moisture in the nozzles N while capping is in progress.

Second Embodiment

Figure 7:
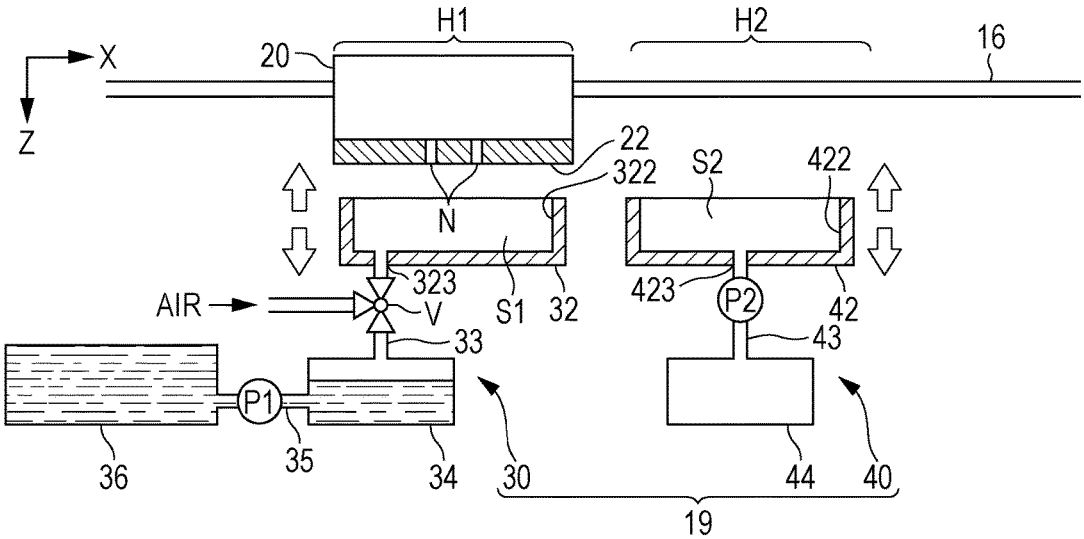
FIG. 7 is a sectional view illustrating the structure of a maintenance unit in a second embodiment.

A second embodiment in the invention will be described. In aspects exemplified below, elements having effects and functions similar to those in the first embodiments will be denoted by the relevant reference numerals used in the first embodiment and detailed descriptions of these elements will be appropriately omitted. FIG. 7 is a sectional view illustrating the structure of the maintenance unit 19 according to the second embodiment. FIG. 7 corresponds to FIG. 2. In the first embodiment, a case has been exemplified in which the air layer S3 is formed in the liquid storage section 34 to absorb the shock of air transmitted to the interiors of the nozzles N when the moisture-retaining cap 32 abuts the ejecting surface 22 or moves apart from it. In the second embodiment, however, a case will be exemplified in which the connection tube 33 connected to the moisture-retaining cap 32 is open to the ambient atmosphere to prevent the shock of air from being transmitted to the interiors of the nozzles N, the shock being generated when the moisture-retaining cap 32 abuts the ejecting surface 22 or moves away from it.

Specifically, the moisture-retaining mechanism 30 in FIG. 7 is structured by adding a switching valve V to the moisture-retaining mechanism 30 in FIG. 2. The switching valve V switches between the state of the recess 322 in the moisture-retaining cap 32 being opened to the ambient atmosphere and the state of the recess 322 communicating with the liquid storage section 34. The switching valve V, which is, for example, a three-way valve, is disposed on the connection tube 33. Detailed descriptions of the structure in FIG. 7 will be omitted because the structure is the same as in FIG. 2, except the structure of the moisture-retaining mechanism 30. With the moisture-retaining mechanism 30 in FIG. 7, when the recess 322 in the moisture-retaining cap 32 is made open to the ambient atmosphere by the switching valve V, the shock of air can be prevented from being transmitted to the interiors of the nozzles N when the moisture-retaining cap 32 abuts the ejecting surface 22 or moves away from it. In this structure as well, therefore, it is possible to restrain meniscuses in the nozzles N from being destroyed by the shock generated when the moisture-retaining cap 32 abuts the ejecting surface 22 or moves away from it.

Figure 8:
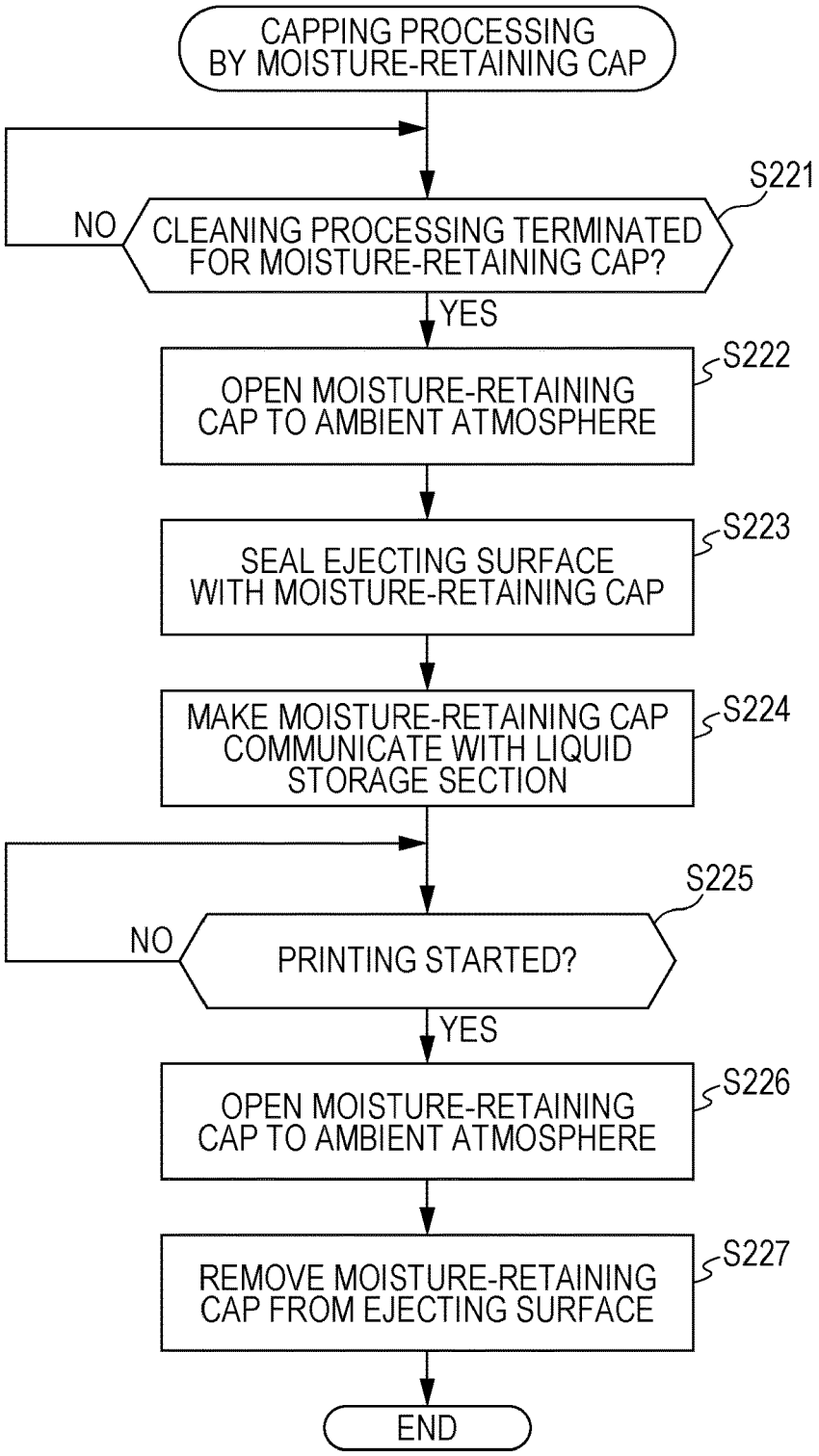
FIG. 8 is a flowchart illustrating capping processing performed by a moisture-retaining cap in the second embodiment.
Figure 9A:
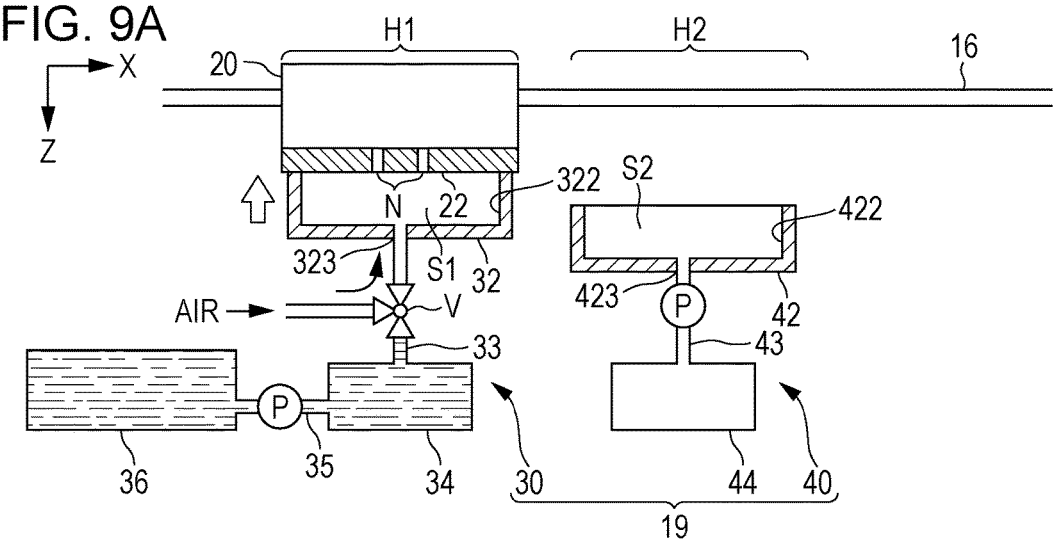
FIG. 9A is a sectional view illustrating a state in which the moisture-retaining cap is in contact in capping processing in FIG. 8.
Figure 9B:
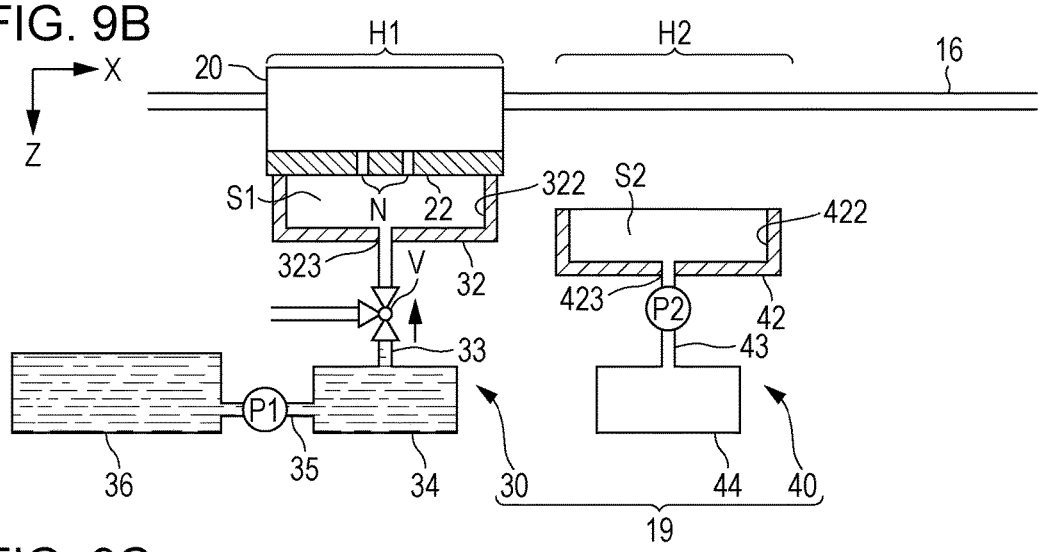
FIG. 9B is a sectional view illustrating a state in which the moisture-retaining cap communicates with a liquid storage section in capping processing in FIG. 8.
Figure 9C:
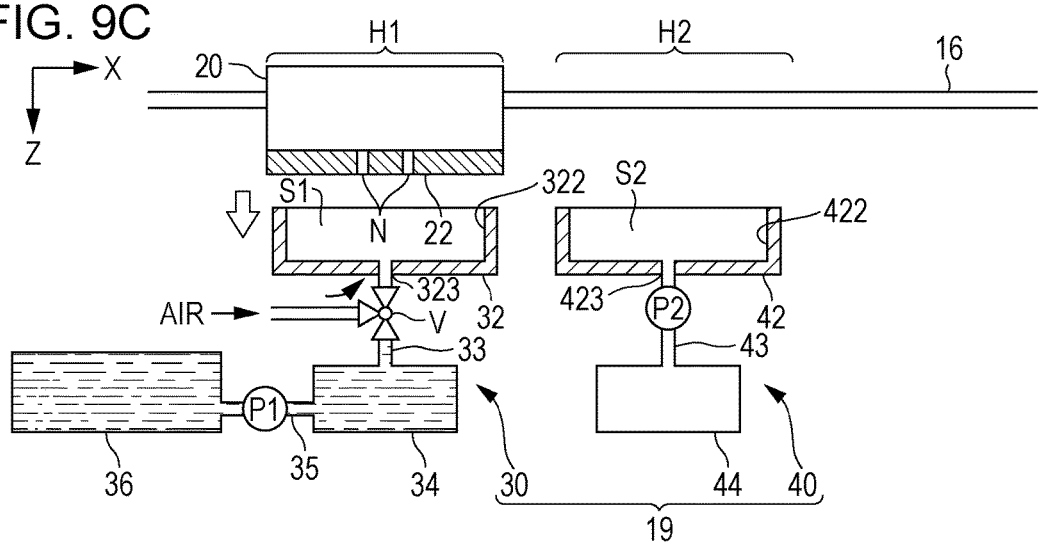
FIG. 9C is a sectional view illustrating a state in which the moisture-retaining cap is removed in capping processing in FIG. 8.

A method of driving the liquid ejecting apparatus 10 that uses the moisture-retaining mechanism 30 in the second embodiment will be described below. FIG. 8 is a flowchart in capping processing performed for the ejecting surface 22 by the moisture-retaining cap 32 in the second embodiment. FIG. 8 corresponds to FIG. 4. FIGS. 9A to 9C are each a sectional view illustrating the state of the moisture-retaining cap 32 in cleaning processing in FIG. 8: FIG. 9A is a sectional view illustrating a state in which the moisture-retaining cap 32 is in contact with the ejecting surface 22. FIG. 9B illustrates a state in which the recess 322 in the moisture-retaining cap 32 communicates with the liquid storage section 34 by the switching valve V. FIG. 9C illustrating a state in which the moisture-retaining cap 32 is removed from the ejecting surface 22.

Cleaning processing in the second embodiment that is performed for the moisture-retaining cap 32 is the same as in FIG. 3, except that, in the second embodiment, the moisture-retaining cap 32 is cleaned in a state in which the recess 322 in the moisture-retaining cap 32 communicates with the liquid storage section 34 by the switching valve V.

As illustrated in FIG. 8, in capping processing in the second embodiment, the controller 122 first decides in step S221 whether cleaning processing has been terminated for the moisture-retaining cap 32. If the controller 122 decides in step S221 that cleaning processing has not been terminated for the moisture-retaining cap 32 (the result is No), the controller 122 waits in 5221 until cleaning processing for the moisture-retaining cap 32 is terminated.

If the controller 122 decides that cleaning processing has been terminated for the moisture-retaining cap 32 in step S221 (the result is Yes), the controller 122 opens the moisture-retaining cap 32 to the ambient atmosphere in step S222 before capping the ejecting surface 22 with the moisture-retaining cap 32. Specifically, as illustrated in FIG. 9A, the controller 122 switches the switching valve V so that the recess 322 in the moisture-retaining cap 32 is opened to the ambient atmosphere.

Next, the controller 122 seals the ejecting surface 22 with the moisture-retaining cap 32 in step S223. Specifically, as illustrated in FIG. 9A, the controller 122 moves the liquid ejecting head 20 to the standby area H1 and moves the moisture-retaining cap 32 toward the negative side in the Z direction so that the moisture-retaining cap 32 abuts the ejecting surface 22. At that time, since the recess 322 in the moisture-retaining cap 32 is open to the ambient atmosphere by the switching valve V, it is possible to restrain the shock of air from being transmitted to the nozzle N when the moisture-retaining cap 32 abuts the ejecting surface 22. Therefore, it is possible to restrain meniscuses in the nozzle N from being destroyed by the shock generated when the moisture-retaining cap 32 abuts the ejecting surface 22.

Next, the controller 122 makes the moisture-retaining cap 32 communicate with the liquid storage section 34 in step S224. Specifically, as illustrated in FIG. 9B, the controller 122 switches the switching valve V so that the recess 322 in the moisture-retaining cap 32 communicates with the liquid storage section 34. Thus, since the liquid storage section 34 communicates with the sealed space S1 through the connection tube 33, moisture can be easily retained in the nozzles N by the liquid in the liquid storage section 34. In addition, since the recess 322 in the moisture-retaining cap 32 has been cleaned, ink that has dripped into the recess 322 can also be removed. Therefore, it is possible to restrain moisture in the nozzles N from being absorbed by ink in the recess 322.

Next, the controller 122 decides in step S225 whether printing has been started. If the controller 122 decides in step S225 that printing has not been started (the result is No), the controller 122 waits with the ejecting surface 22 covered with the moisture-retaining cap 32 in step S225 until printing is started.

If the controller 122 decides in step S225 that printing has been started (the result is Yes), the controller 122 opens the moisture-retaining cap 32 to the ambient atmosphere in step S226. Specifically, as illustrated in FIG. 9C, the controller 122 switches the switching valve V so that the recess 322 in the moisture-retaining cap 32 is opened to the ambient atmosphere. The controller 122 then removes the moisture-retaining cap 32 from the ejecting surface 22 in step S227. Specifically, as illustrated in FIG. 9C, the controller 122 moves the moisture-retaining cap 32 toward the positive side in the Z direction to remove the moisture-retaining cap 32 from the ejecting surface 22 and terminates capping processing. At that time, since the recess 322 in the moisture-retaining cap 32 is open to the ambient atmosphere by the switching valve V, it is possible to restrain the shock of air from being transmitted to the nozzles N when the moisture-retaining cap 32 is removed from the ejecting surface 22. Therefore, it is possible to restrain meniscuses in the nozzles N from being destroyed by the shock generated when the moisture-retaining cap 32 is removed from the ejecting surface 22.

Third Embodiment

Figure 10:
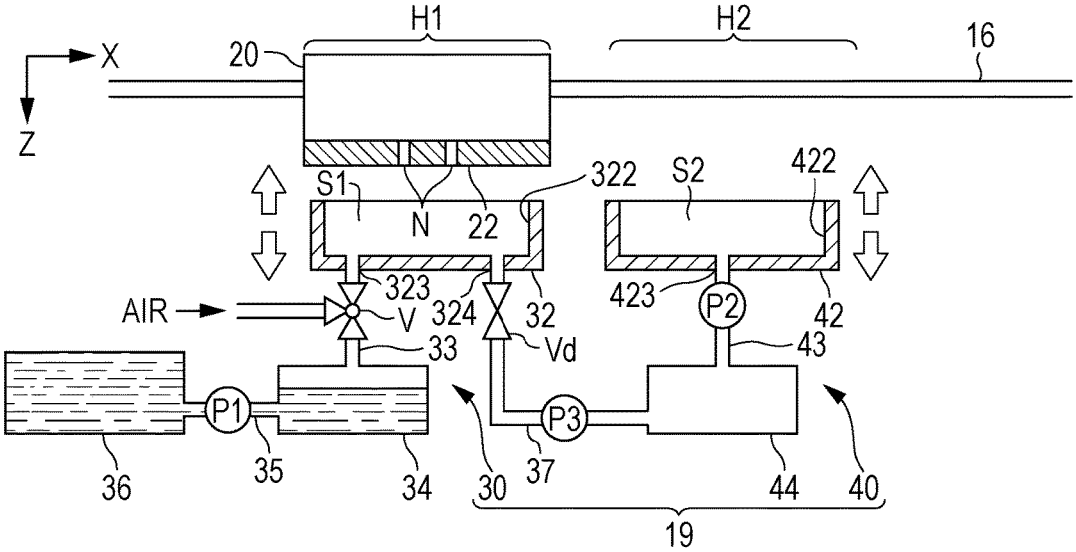
FIG. 10 is a sectional view illustrating the structure of a maintenance unit in a third embodiment.

A third embodiment of the invention will be described. FIG. 10 is a sectional view illustrating the structure of the maintenance unit 19 in the third embodiment. FIG. 10 corresponds to FIG. 7. In the third embodiment, a case will be exemplified in which a discharge tube 37 is connected to the moisture-retaining cap 32 separately from the connection tube 33 and liquid in the moisture-retaining cap 32 is discharged through the discharge tube 37.

Specifically, the moisture-retaining mechanism 30 in FIG. 10 has a through-hole 324 besides the through-hole 323, in FIG. 7, which passes through the bottom wall of the moisture-retaining cap 32. One end of the discharge tube 37 is connected to the through-hole 324. The other end of the discharge tube 37 is connected to the waste liquid section 44 in the cleaning mechanism 40. An opening/closing valve Vd and a suction pump P3 are provided on the discharge tube 37. The opening/closing valve Vd is disposed closer to the moisture-retaining cap 32 than the suction pump P3 is. The opening/closing valve Vd opens and closes the discharge tube 37. With the moisture-retaining mechanism 30 in FIG. 10, liquid in the recess 322 in the moisture-retaining cap 32 can be discarded into the waste liquid section 44 through the discharge tube 37, without the liquid being returned to the liquid storage section 34 through the connection tube 33. Therefore, if the liquid in the recess 322 is dirty, the liquid can be discarded through the discharge tube 37.

Figure 11:
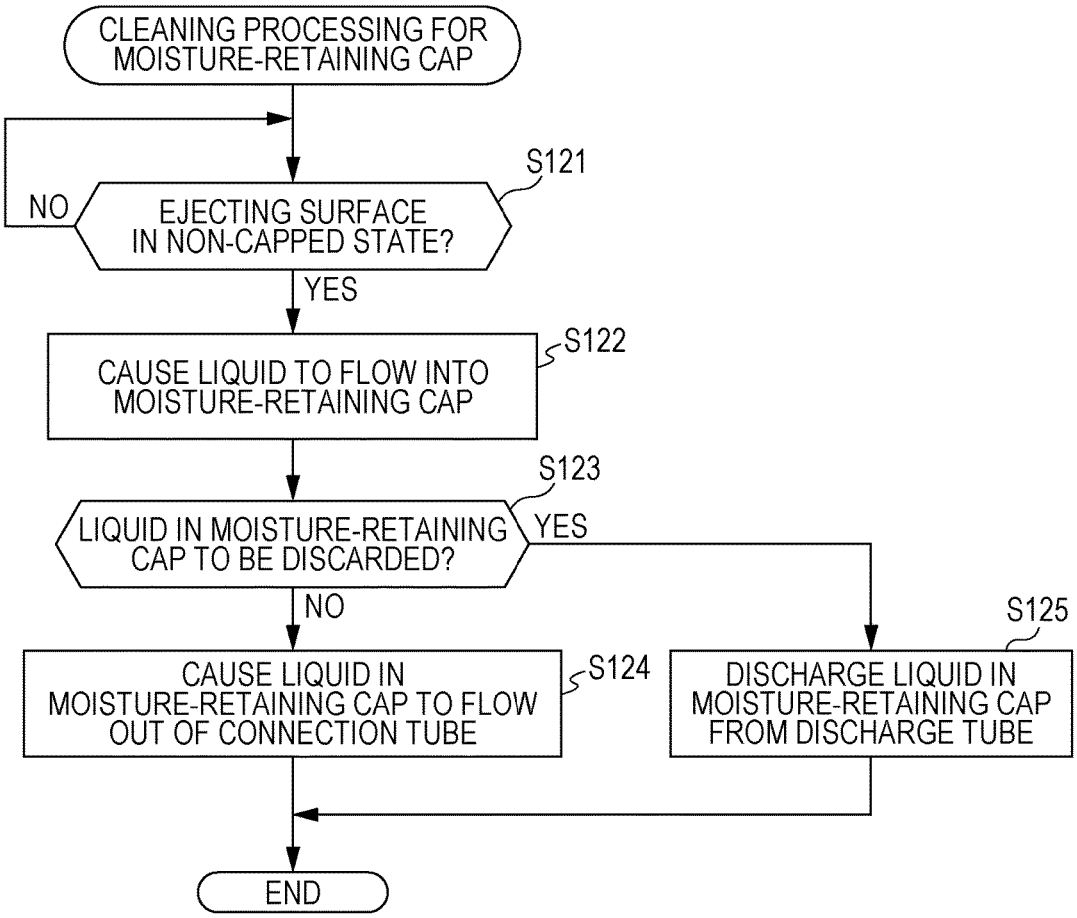
FIG. 11 is a flowchart illustrating cleaning processing for a moisture-retaining cap according to the third embodiment.
Figure 12A:
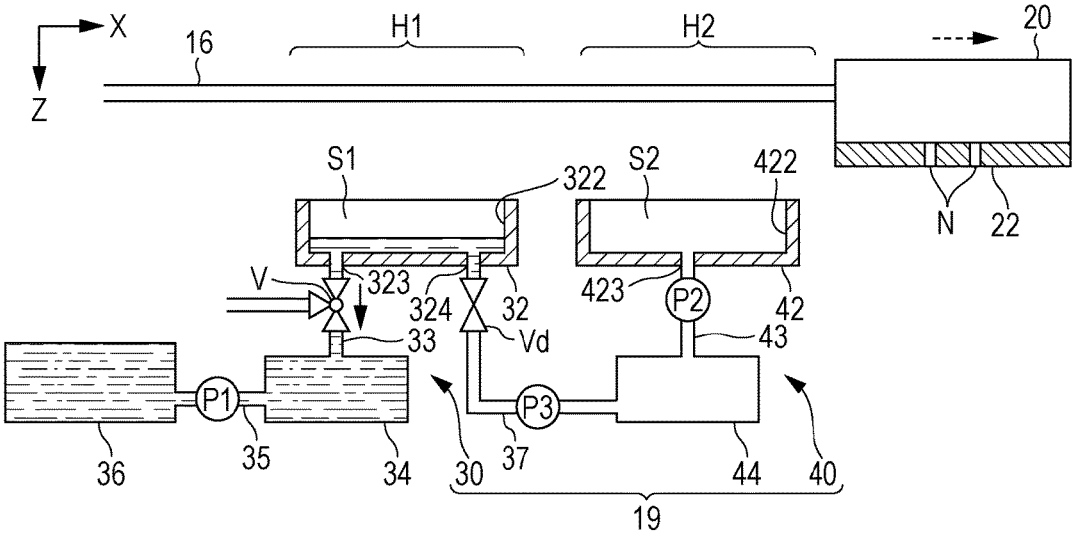
FIG. 12A is a sectional view illustrating a state in which liquid in the moisture-retaining cap flows out through a connection tube in cleaning processing in FIG. 11.
Figure 12B:
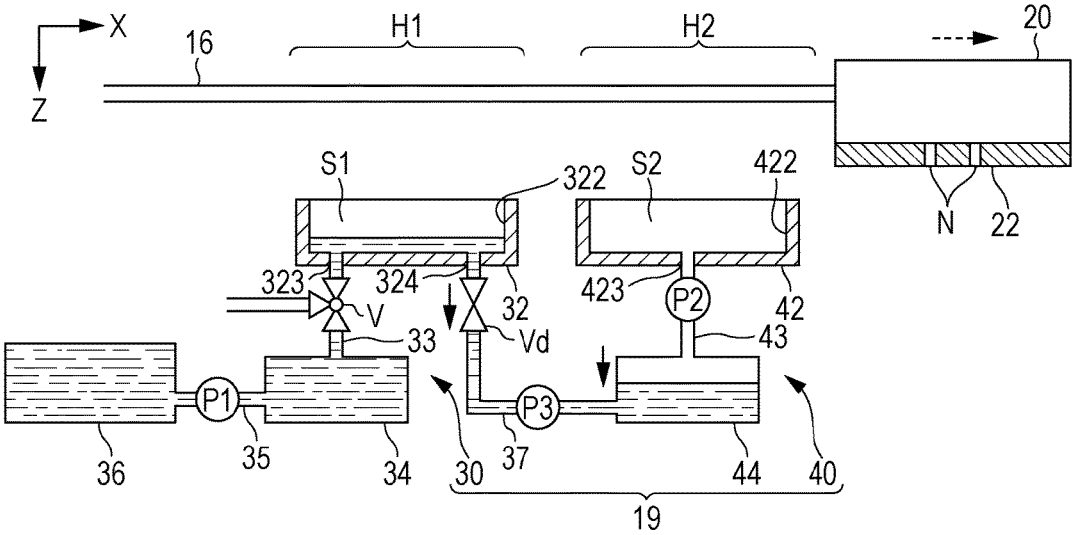
FIG. 12B is a sectional view illustrating a state in which liquid in the moisture-retaining cap is discharged through a discharge tube in cleaning processing in FIG. 11.

A method of driving the liquid ejecting apparatus 10 that uses the moisture-retaining mechanism 30 in the third embodiment will be described below. FIG. 11 is a flowchart in cleaning processing for the moisture-retaining cap 32 according to the third embodiment. FIG. 11 corresponds to FIG. 3. FIGS. 12A and 12B are each a sectional view illustrating the state of the moisture-retaining cap 32 in cleaning processing in FIG. 11: FIG. 12A illustrates a state in which liquid in the moisture-retaining cap 32 flows out through the connection tube 33 and FIG. 12B illustrates a state in which liquid in the moisture-retaining cap 32 is discharged from the discharge tube 37. Detailed descriptions of capping processing by the moisture-retaining cap 32 in the third embodiment will be omitted because the processing is similar to capping processing in FIG. 8.

As illustrated in FIG. 11, in cleaning processing for the moisture-retaining cap 32 in the third embodiment, the controller 122 first decides in step S121 whether the ejecting surface 22 of the liquid ejecting head 20 is not capped, that is, the ejecting surface 22 is in a non-capped state. If the controller 122 decides in step S121 that the ejecting surface 22 of the liquid ejecting head 20 is not in the non-capped state (the result is No), the controller 122 waits in step S121 until the ejecting surface 22 of the liquid ejecting head 20 enters the non-capped state.

If the controller 122 decides in step S121 that the ejecting surface 22 of the liquid ejecting head 20 is in the non-capped state (the result is Yes), the controller 122 causes the liquid to flow into the moisture-retaining cap 32 in step S122. Specifically, the controller 122 switches the switching valve V so that the recess 322 in the moisture-retaining cap 32 communicates with the liquid storage section 34 with the opening/closing valve Vd closed. The controller 122 then drives the liquid-feeding pump P1 to cause liquid to flow out of the liquid storage section 34 and into the recess 322 in the moisture-retaining cap 32 through the connection tube 33. In this case, the controller 122 supplies the liquid to an extent that the liquid does not spill from the recess 322.

Next, the controller 122 decides in step S123 whether to discard the liquid in the moisture-retaining cap 32. If the controller 122 decides not to discard the liquid in the moisture-retaining cap 32 in step S123 (the result is No), the controller 122 causes the liquid in the moisture-retaining cap 32 to flow out through the connection tube 33 in step S124. Specifically, as illustrated in FIG. 12A, while the recess 322 in the moisture-retaining cap 32 is left communicating with the liquid storage section 34 by the switching valve V, the controller 122 drives the liquid-feeding pump P1 with the opening/closing valve Vd closed to cause liquid to flow out of the recess 322 in the moisture-retaining cap 32 and into the liquid storage section 34 through the connection tube 33. In this case, if there is no more liquid in the recess 322, the controller 122 terminates cleaning processing for the moisture-retaining cap 32.

If the controller 122 decides to discard the liquid in the moisture-retaining cap 32 in step S123 (the result is Yes), the controller 122 discharges the liquid in the moisture-retaining cap 32 through the discharge tube 37 in step S125. Specifically, as illustrated in FIG. 12B, the controller 122 closes the switching valve V with the opening/closing valve Vd open and drives the suction pump P3 to, through the discharge tube 37, draw the liquid from the recess 322 in the moisture-retaining cap 32 and discharge the liquid into the waste liquid section 44. In this case, if there is no more liquid in the recess 322, the controller 122 terminates cleaning processing for the moisture-retaining cap 32. As described above, with the moisture-retaining mechanism 30 in the third embodiment, liquid in the recess 322 in the moisture-retaining cap 32 can be discarded through the discharge tube 37, without the liquid being returned to the liquid storage section 34 through the connection tube 33. Therefore, if the liquid in the recess 322 is dirty, the liquid can be discarded through the discharge tube 37.

An example in which the controller 122 decides whether to discard the liquid in the moisture-retaining cap 32 will be described below. The controller 122 detects dirt in the recess 322 in the moisture-retaining cap 32 by, for example, analyzing an image taken with a camera or using a sensor or the like before the controller 122 causes liquid to flow into to the recess 322. If the controller 122 determines, through image analysis or from a detection result obtained from the sensor or the like, that the amount of dirt is smaller than a predetermined amount, the controller 122 decides not to discard the liquid in the moisture-retaining cap 32. If the amount of dirt is equal to or larger than the predetermined amount, the controller 122 decides to discard the liquid in the moisture-retaining cap 32. Operations in steps S123 and S124 can be repeated multiple times. Similarly, operations in steps S123 and S125 can be repeated multiple times. Furthermore, after operations in steps S123 and S125, operations in steps S123 and S124 can be performed and then cleaning for the moisture-retaining cap 32 can be terminated.

Fourth Embodiment

Figure 13:
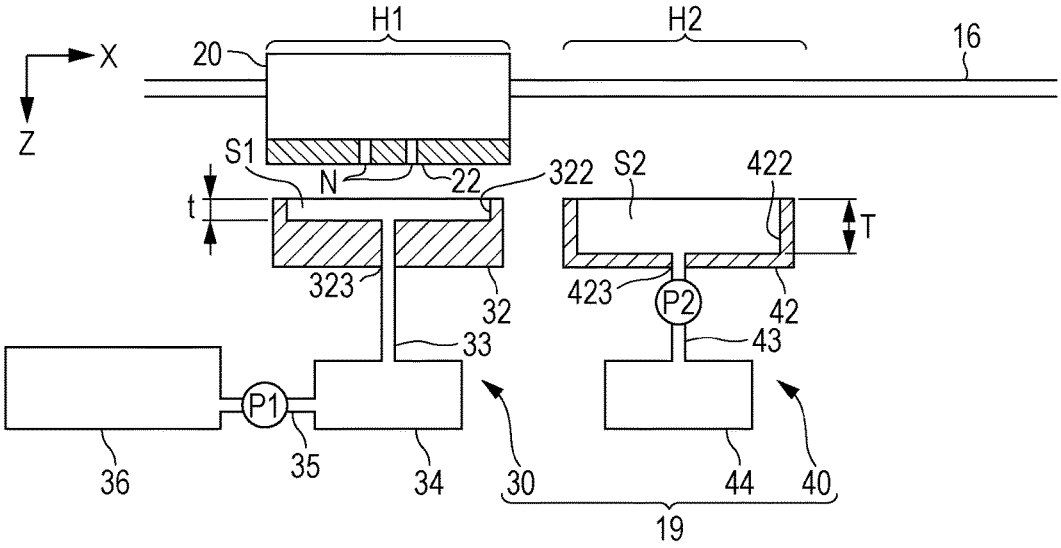
FIG. 13 is a sectional view illustrating the structure of a maintenance unit in a fourth embodiment.

A fourth embodiment of the invention will be described. FIG. 13 is a sectional view illustrating the structure of the maintenance unit 19 according to the fourth embodiment. FIG. 13 corresponds to FIG. 2. In the fourth embodiment, a case will be exemplified in which the recess 322 in the moisture-retaining cap 32 has a smaller volume than the recess 422 in the cleaning cap 42. The depth t of the recess 322 in the moisture-retaining cap 32 in FIG. 13 is smaller than the depth T of the recess 422 in the cleaning cap 42. Thus, the volume (sealed space S1) of the recess 322 in the moisture-retaining cap 32 can be made smaller than the volume (sealed space S2) of the recess 422 in the cleaning cap 42. With this structure in the fourth embodiment, since the effect of retaining moisture in the recess 322 in the moisture-retaining cap 32 can be increased by reducing the volume of the recess 322, the sealed space S1 in the recess 322 can be moistened within a short time.

Figure 14:
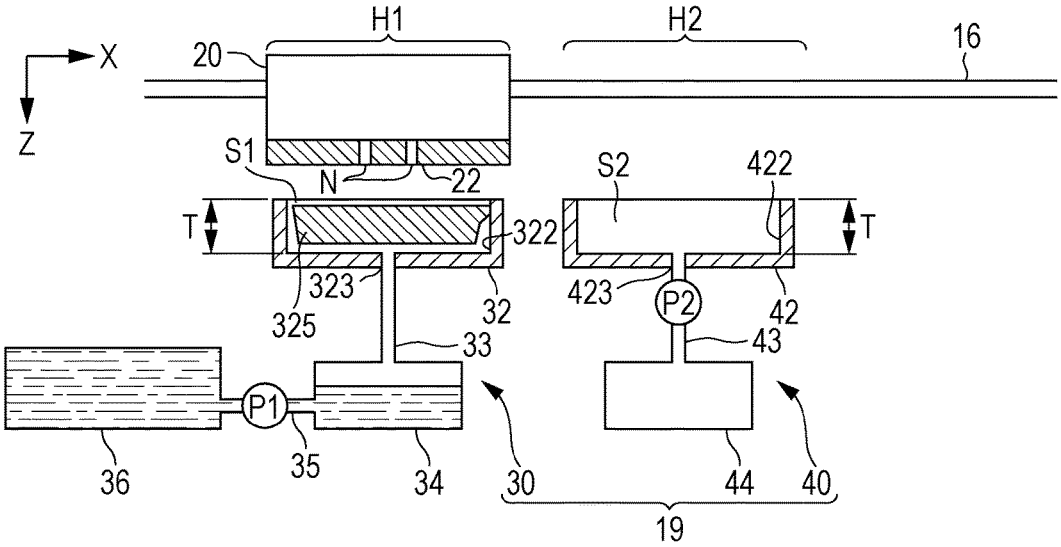
FIG. 14 is a sectional view illustrating the structure of a moisture retaining mechanism according to a variation of the fourth embodiment.

The structure of the moisture-retaining mechanism 30 in the fourth embodiment is not limited to the structure illustrated in FIG. 13. For example, to reduce the volume of the recess 322 in the moisture-retaining cap 32, a volume-reducing member 325 that does not allow transmission of a liquid may be disposed in the recess 322, as in the moisture-retaining mechanism 30 in a variation, illustrated in FIG. 14, of the fourth embodiment. In the structure in FIG. 14, the volume-reducing member 325 is provided in the recess 322, but the volume-reducing member 325 is not provided in the recess 422. With this structure, even if the recess 322 in the moisture-retaining cap 32 has the same depth T as the recess 422 in the cleaning cap 42, the volume of the recess 322 can be made smaller than the volume of the recess 422.

Fifth Embodiment

Figure 15:
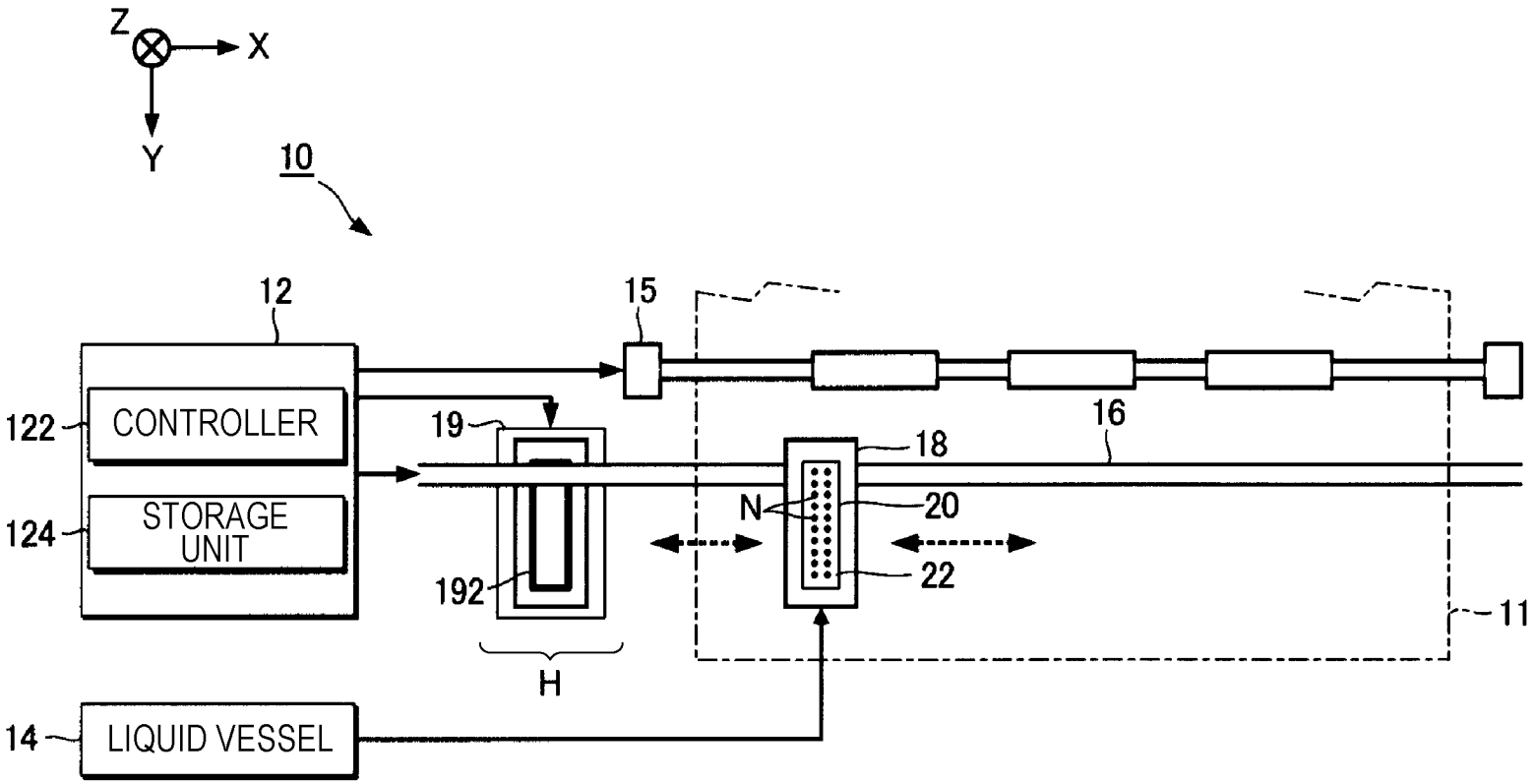
FIG. 15 illustrates part of the structure of a liquid ejecting apparatus according to a fifth embodiment.
Figure 16:
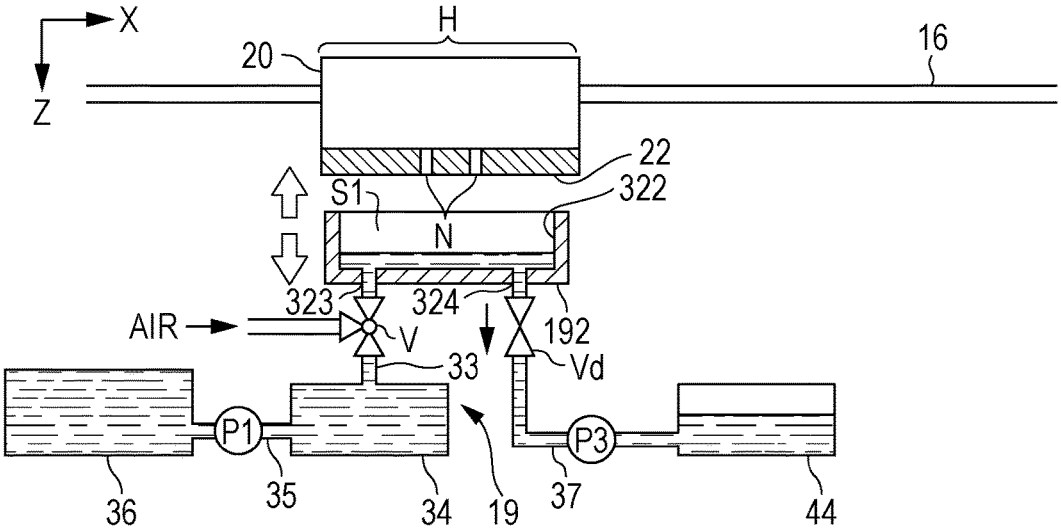
FIG. 16 is a sectional view that illustrates the structure of a maintenance unit in the fifth embodiment.

A fifth embodiment of the invention will be described. In the first to fourth embodiments, the maintenance unit 19 in which the moisture-retaining mechanism 30 and cleaning mechanism 40 are separately structured has been exemplified. In the fifth embodiment, however, a structure will be exemplified that can fulfill both the function of the moisture-retaining mechanism 30 and the function of the cleaning mechanism 40 with a single cap 192 included in the maintenance unit 19. FIG. 15 illustrates part of the structure of the liquid ejecting apparatus 10 according to the fifth embodiment. FIG. 15 corresponds to FIG. 1. FIG. 16 is a sectional view that illustrates the structure of the maintenance unit 19 according to the fifth embodiment. FIG. 16 corresponds to FIG. 10.

The maintenance unit 19 in FIG. 16 has a single cap 192 that doubles as a moisture-retaining cap and a cleaning cap. The structure of the cap 192 is similar to the structure of the moisture-retaining cap 32 in FIG. 10; the cap 192, which is shaped substantially like a box, has the recess 322 that has an opening on the negative side in the Z direction. When the edge of the opening comes into contact with the ejecting surface 22 of the liquid ejecting head 20, the ejecting surface 22 is capped (sealed), forming the sealed space S1, which is enclosed by the recess 322 and ejecting surface 22, in the recess 322 in the cap 192. By using a motor (not illustrated) under control of the control unit 12, the cap 192 can be raised toward the negative side (moved upward) in the Z direction, in which the cap 192 comes into contact with the ejecting surface 22 or can be lowered toward the positive side (moved downward) in the Z direction, in which the cap 192 moves away from the ejecting surface 22.

While the liquid ejecting head 20 is in the non-printing area H during non-printing, the maintenance unit 19 in FIG. 16 caps the ejecting surface 22 with the cap 192 to enable the liquid ejecting head 20 to retain moisture. Detailed descriptions of the specific effect of the moisture-retaining function in FIG. 16 will be omitted because the effect is similar to the effect of the moisture-retaining mechanism 30 in FIG. 10. While the liquid ejecting head 20 is in the non-printing area H during cleaning, the maintenance unit 19 in FIG. 16 caps the ejecting surface 22 with the cap 192 and cleans the liquid ejecting head 20. When the maintenance unit 19 in FIG. 16 cleans the liquid ejecting head 20 by suction, the switching valve V is closed and the opening/closing valve Vd is opened with the ejecting surface 22 capped with the cap 192, after which the suction pump P3 is driven to suck ink from the nozzle N. Since a single cap 192 doubles as a moisture-retaining cap and a cleaning cap as described above, the number of parts can be reduced.

Variations

The aspects and embodiments exemplified above can be varied in various ways. Aspects of specific variations will be exemplified below. Two or more aspects arbitrarily selected from examples below and the above aspects can be combined within a range in which any mutual contradiction does not occur.

(1) In the embodiments described above, a serial head has been exemplified that repeatedly reciprocate the carriage 18 on which the liquid ejecting head 20 is mounted, along the X direction. However, the invention can also be applied to a line head in which the liquid ejecting head 20 is disposed across the entire width of the medium 11.

(2) In the embodiments described above, the liquid ejecting head 20 in a piezoelectric method has been exemplified; in the piezoelectric method, a piezoelectric element that gives mechanical vibration to the pressure chamber is used.

However, it is also possible to use a liquid ejecting head in a thermal method in which heat is used to generate bubbles in the pressure chamber.

(3) The liquid ejecting apparatus 10 exemplified in the embodiments described above can be used not only in a device specific to printing but also in other various types of devices such as a facsimile machine and a copier. Of course, applications of the liquid ejecting apparatus 10 in the invention are not limited to printing. For example, a liquid ejecting apparatus that ejects a solution of a color material is used as a manufacturing apparatus that forms a color filter in a liquid crystal display, an organic electroluminescent (EL) display, a field emission display (FED), or the like. A liquid ejecting apparatus that ejects a solution of a conductive material is used as a manufacturing apparatus that forms wires and electrodes on a wiring board. Another type of liquid ejecting apparatus can be used as a chip manufacturing apparatus that ejects a solution of a bio-organic substance as a type of solution.

The entire disclosure of Japanese Patent Application No. 2017-159784, filed Aug. 22, 2017 is expressly incorporated by reference herein

What is claimed is:

1. A liquid ejecting apparatus comprising:

a liquid ejecting head having an ejecting surface on which a nozzle that ejects a first liquid is formed;

a cap having a recess configured to cover the nozzle when the ejecting surface is capped with the cap;

a liquid storage section configured to store a second liquid;

a connection tube configured to interconnect the recess and the liquid storage section;

a pump configured to cause the second liquid to flow from the liquid storage section into the recess through the connection tube and to flow out of the recess and into the liquid storage section through the connection tube;

a controller configured to control the pump so that the second liquid flows from the liquid storage section to the recess through the connection tube and the second liquid flows from the recess to the liquid storage section through the connection tube in a state of that the ejecting surface is not capped with the cap.

2. The liquid ejecting apparatus according to claim 1, wherein an air layer that communicates with the recess through the connection tube is formed in the liquid storage section before the ejecting surface is capped with the cap.

3. The liquid ejecting apparatus according to claim 1, further comprising:

a switching valve configured to switch between a state of the recess being opened to an ambient atmosphere through the connection tube and a state of the recess communicating with the liquid storage section through the connection tube.

4. The liquid ejecting apparatus according to claim 1, further comprising:

a discharge tube configured to discharge the first and second liquids from the recess.

5. A method of driving a liquid ejecting apparatus that includes a liquid ejecting head having an ejecting surface on which a nozzle that ejects a first liquid is formed, a cap having a recess configured to cover the nozzle when the ejecting surface is capped with the cap, a liquid storage section configured to store a second liquid to flow into the recess, a connection tube configured to interconnect the recess and the liquid storage section, and a pump configured to cause the second liquid to flow from the liquid storage section into the recess through the connection tube and to flow out of the recess and into the liquid storage section through the connection tube, the method comprising:

causing the second liquid to flow from the liquid storage section into the recess through the connection tube and then to flow out of the recess and into the liquid storage section through the connection tube by using the pump while the ejecting surface is not capped, and capping the ejecting surface with the cap after the second liquids in the recess have flowed out.

6. The method according to claim 5, further comprising:

forming an air layer that communicates with the recess through the connection tube in the liquid storage section before the ejecting surface is capped with the cap.

7. The method according to claim 5, wherein the liquid ejecting apparatus further includes a switching valve configured to switch between a state of the recess being opened to an ambient atmosphere through the connection tube and a state of the recess communicating with the liquid storage section through the connection tube, the method further comprising:

switching to the state of the recess communicating with the liquid storage section by the switching valve before the second liquid is flowed between the liquid storage section and the recess through the connection tube;

switching to the state of the recess being opened to the ambient atmosphere by the switching valve till the ejecting surface is capped by the cap after the second liquid is flow out the recess; and switching to the state of the recess communicating with the liquid storage section by the switching valve after the ejecting surface is capped by the cap.

8. The method according to claim 5, wherein the liquid ejecting apparatus further includes a discharge tube configured to discharge the second liquids in the recess, the method further comprising:

after the second liquid has flowed into the recess, the second liquids are discharged from the recess through the discharge tube or flow out of the recess and into the liquid storage section through the connection tube.

* * * * *